US006164749A

United States Patent [19]

Williams

[11] Patent Number: 6,164,749

[45] Date of Patent: Dec. 26, 2000

[54] METHOD FOR USER ALIGNMENT OF A COLOR PRINTER

[75] Inventor: Kenneth R. Williams, Vancouver, Wash.

[73] Assignee: Hewlett-Packard Company, Palo Alto, Calif.

[21] Appl. No.: 08/819,428

[22] Filed: Mar. 17, 1997

[51] Int. Cl.[7] ..... B41J 29/393

[52] U.S. Cl. ..... 347/19

[58] Field of Search ..... 347/19, 118, 43, 347/115, 23; 350/501; 250/573

[56] References Cited

U.S. PATENT DOCUMENTS

| | | | |
|---|---|---|---|
| 4,675,696 | 6/1987 | Suzuki | 347/19 |
| 5,350,929 | 9/1994 | Meyers et al. | 347/19 |
| 5,448,269 | 9/1995 | Beauchamp et al. | 347/19 |
| 5,455,608 | 10/1995 | Stewart et al. | 347/19 |

FOREIGN PATENT DOCUMENTS

| | | | |
|---|---|---|---|
| 0589718A1 | 3/1994 | European Pat. Off. . | |
| 63-153151 | 6/1988 | Japan | 347/19 |

OTHER PUBLICATIONS

Hewlett–Packard Patent Application; S/N 08/636,439; Filed Apr. 22, 1996; "Systems And Method For Determining Presence Of Inks That Are Invisible To Sensing Devices".

*Primary Examiner*—John Barlow
*Assistant Examiner*—Charles W. Stewart, Jr.

[57] ABSTRACT

A semi-automatic, user-interactive solution to a color printer's inter-pen misalignment is described. Plural test patterns are printed using two or more possibly misregistered color pens, and the operator selects the best, or a preferred, alignment pattern. The operator's choice of pattern is entered into the ink-jet printer's controller and adjustment, e.g. offset, data are stored by the controller in a non-volatile memory device to be used in subsequent printing to better align the misaligned color pens. Importantly, the test patterns use a linear hash-mark from one of the separate pens, e.g. black (K), and adjacent thereto a color combination from plural others of the separate pens, e.g. yellow (Y) and cyan (C), to produce alignment patterns that are readily visible to the operator. In accordance with the preferred method, an alignment pattern includes a background patch of visible ink, e.g. cyan, and a foreground linear hash-mark of 'invisible' ink, e.g. yellow. Alternatively, the alignment pattern may include a background patch of visible ink, e.g. cyan, and a foreground patch minus the linear hash-mark, of 'invisible' ink, e.g. yellow. In either case, a plural-color target or test pattern is produced the contrast of which is relatively higher than that of 'invisible' ink alone on a white medium, wherein the combination of the two colored inks produces a feature, whether by its presence or absence, that is linear, for visual alignment with the adjacent nominally aligned linear black ink feature.

11 Claims, 2 Drawing Sheets

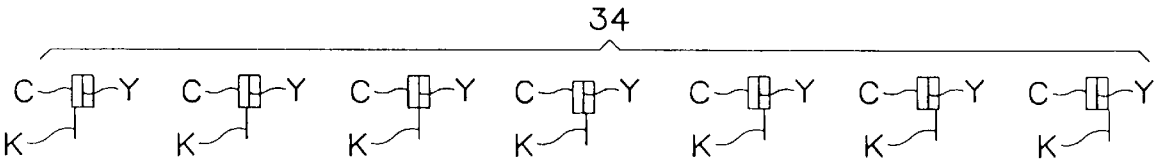
FIG.2
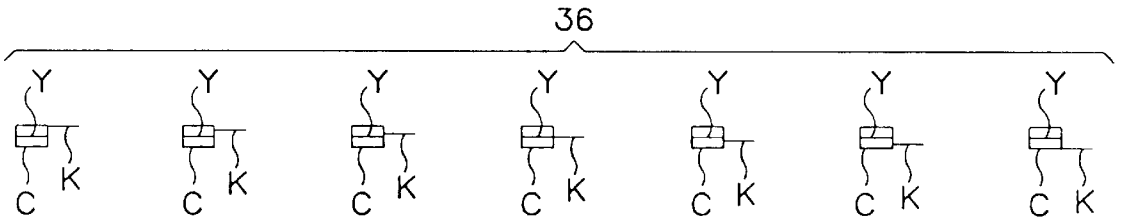
FIG.3
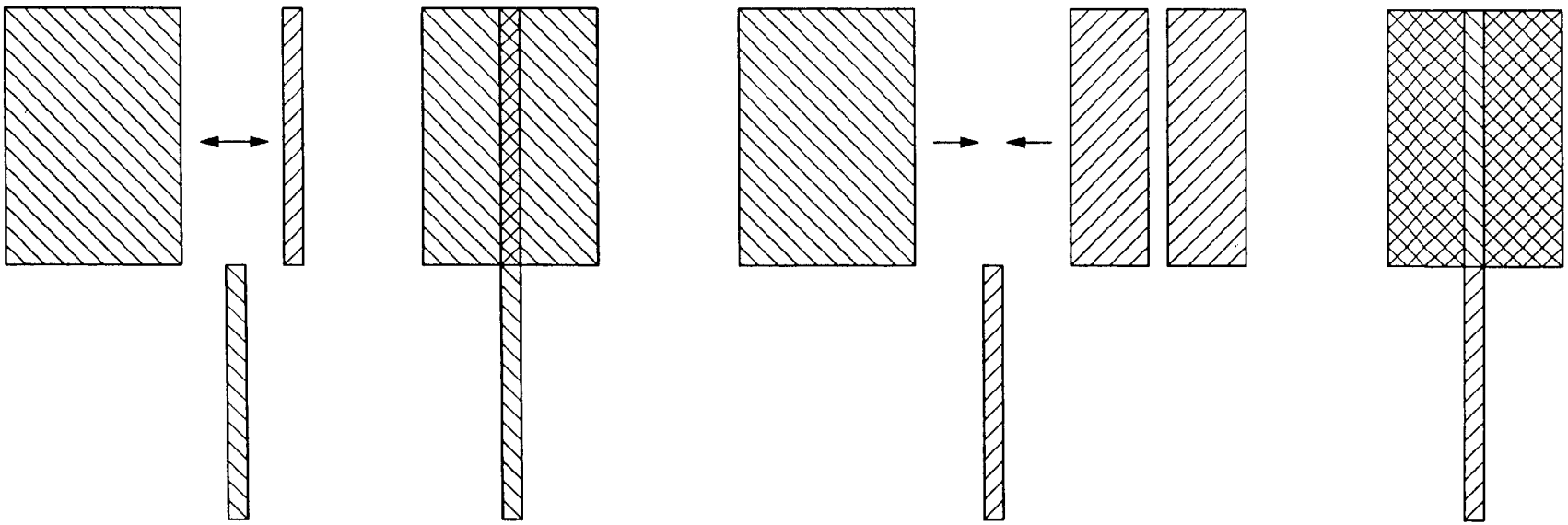
FIG.4A
FIG.4B
FIG.5A
FIG.5B

METHOD FOR USER ALIGNMENT OF A COLOR PRINTER

TECHNICAL FIELD

The present invention relates generally to color printers. More particularly, it concerns a method for laying down ink from two or more color pens to print plural, progressively aligned target test patterns, having the operator choose from among them the pattern illustrating the best inter-pen alignment and recording in non-volatile memory alignment data corresponding with the chosen pattern for use in subsequent printing. The invention is described and illustrated herein in the context of four-color ink-jet printers, but is not so limited in its application.

BACKGROUND ART

Typically, four-color inkjet printers have replaceable ink cartridges providing cyan (C), yellow (Y), magenta (M) and black (K) ink printing. Four separate color cartridges are provided, rather than providing them in a mono-block configuration, typically to increase yield in manufacture. Precise alignment among the various ink cartridges, or pens, is required to produce high quality print without noticeable dot misregistration, color variegation or other undesirable visual effects. For example, in order to print a dark cyan line, a linear array of cyan and black dots must be placed precisely on top of one another. Otherwise, the resulting pattern would appear as two parallel lines of cyan and black. Such slight misalignment, or misregistration, between two or more ink pens could be adjusted for by a shift of the image to be printed as between the two colors prior to printing. Thus, in a four-color printer wherein, as is typical, a black ink pen and three color ink pens are provided in the form of separate, changeable pens or cartridges, alignment between the independent, and possibly slightly misaligned, pens is required. Such inter-pen or inter-color misalignment of course is not limited to the case where the various pens are physically separate, as misalignment may result from dimensional tolerances in the manufacture of, for example, a mono-block printhead having two or more integrated ink cartridges and associated ink droplet outlets or orifices.

Interactive techniques for making alignment adjustments have been developed whereby an inkjet printer's controller causes plural, progressive alignment target patterns, e.g. nominally aligned black and adjacent primary colored line segments, to be printed and the operator chooses the best alignment pattern and enters such a choice into the printer controller's memory, whereby the printer uses such stored alignment data thereafter to properly align images produced by the slightly misaligned pens. Such a technique is described in European Application number 93307586.3 entitled PEN ALIGNMENT METHOD AND APPARATUS FOR PLURAL PEN INK-JET PRINTHEAD CARRIAGE, which was filed Sep. 24, 1993 claiming priority of U.S. patent application Ser. No. 951,067 filed Sep. 25, 1992, which was published as EP Publication number 0 589 718 A1 on Mar. 30, 1994, which was granted Jan. 8, 1997 as European Patent No. EP 0589718, and which is commonly assigned herewith. Familiarity with the disclosure of that patent is assumed. That patent disclosure does not address the problem of inter-pen alignment as between yellow and another color of ink whereby a yellow target alignment pattern printed on a white print medium may be invisible or virtually invisible to the operator.

A method for rendering such an "invisible" ink image capable of being sensed by an opto-electronic sensor in an ink-jet printer is described in U.S. patent application Ser. No. 08/636,439 entitled SYSTEM AND METHOD FOR DETERMINING PRESENCE OF INKS THAT ARE INVISIBLE TO SENSING DEVICES, which was filed Apr. 22, 1996, and which is commonly assigned herewith. That application describes an automatic process for relatively high-performance and -cost printers whereby a fractional fill pattern is produced using visible ink, immediately followed by a fractional fill pattern within the same region produced by using an invisible ink, e.g. yellow. Ink bleeding within the region, as between the visible and invisible inks, produces a relatively more solid fill, thereby rendering the pattern capable of being detected by a built-in optical sensor. The application does not suggest inexpensive, semi-automatic, user-interactive inter-pen alignment.

DISCLOSURE OF THE INVENTION

Briefly, the invented method provides a semi-automatic, user-interactive solution to inter-pen misalignment. Plural test patterns are printed using two or more possibly misregistered color pens, and the operator selects the best, or a preferred, alignment pattern. The operator's choice of pattern is entered into the inkjet printer's controller and adjustment, e.g. offset, data are stored by the controller in a non-volatile memory device to be used in subsequent printing to better align the misaligned color pens. Importantly, the test patterns use a linear hash-mark from one of the separate pens, e.g. black (K), and adjacent thereto a color combination from plural others of the separate pens, e.g. yellow (Y) and cyan (C), to produce alignment patterns that are readily visible to the operator. In accordance with the preferred method, an alignment pattern includes a background patch of visible ink, e.g. cyan, and a foreground linear hash-mark of 'invisible' ink, e.g. yellow. Alternatively, the alignment pattern may include a background patch of visible ink, e.g. cyan, and a foreground patch—minus the linear hash-mark—of 'invisible' ink, e.g. yellow. In either case, a plural-color target or test pattern is produced the contrast of which is relatively higher than that of 'invisible' ink alone on a white medium, wherein the combination of the two colored inks produces a feature, whether by its presence or absence, that is linear, for visual alignment with the adjacent, nominally aligned linear black ink feature.

Those of skill in the art will appreciate that by 'invisible' is meant an ink the color of which is relatively invisible against a white background. The invented method is applicable to any printing task wherein it is desired to render a relatively low-contrast, inked portion of an image relatively more easily seen by the naked eye.

These and additional objects and advantages of the present invention will be more readily understood after consideration of the drawings and the detailed description of the preferred embodiment which follows.

BRIEF DESCRIPTION OF THE DRAWINGS

FIG. 2 is a first alignment test pattern that may be printed in accordance with the invention.

FIG. 3 is a second alignment test pattern that may be printed in accordance with the invention.

FIGS. 4A and 4B are a detailed illustration of a preferred method of producing the individual graphic components of the patterns of FIG. 2 in accordance with the invention.

FIGS. 5A and 5B are a detailed illustration of an alternative method of producing the individual graphic components of the patterns of FIG. 2 in accordance with another aspect of the invention.

Figure 1:
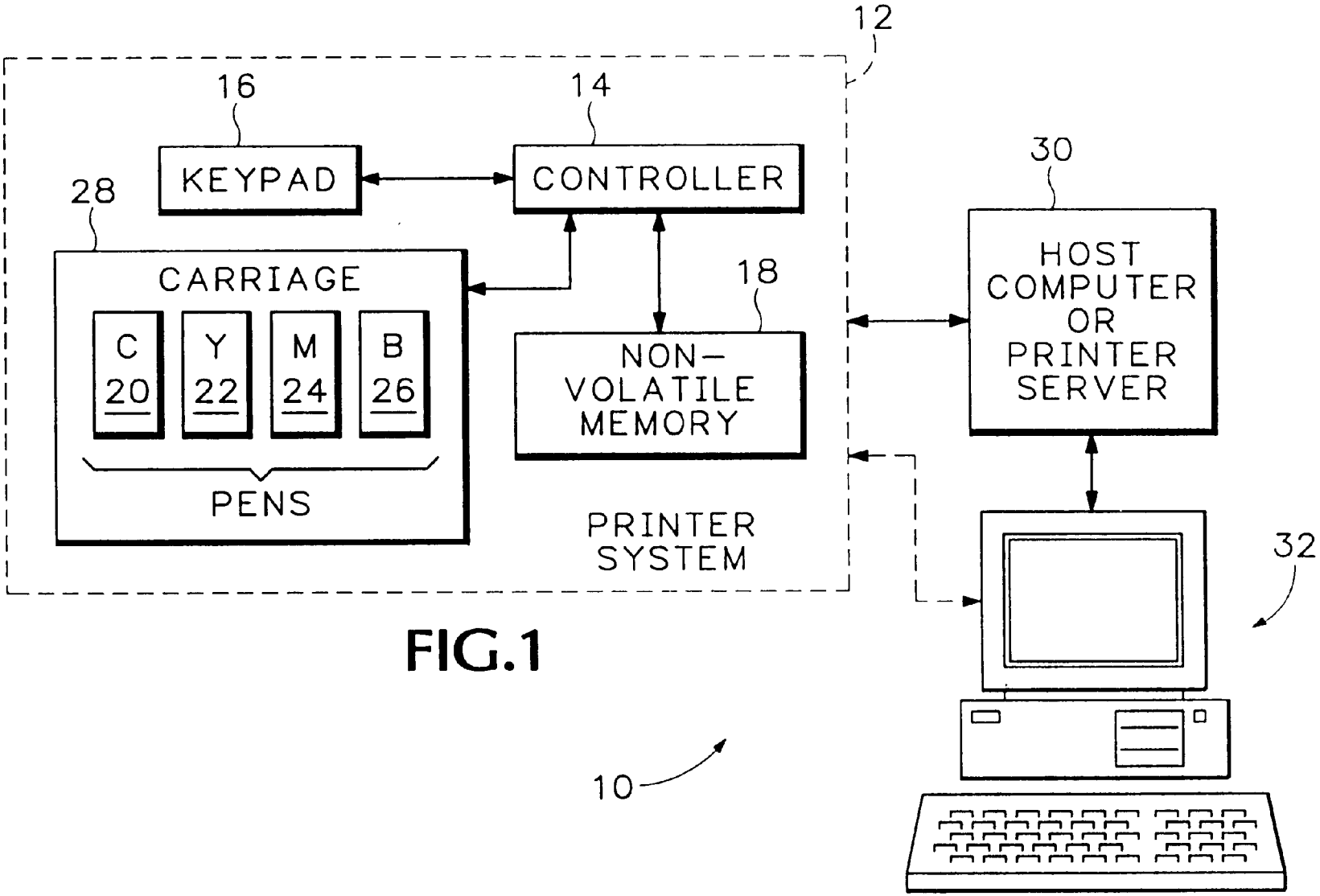
FIG. 1 is a printer system block diagram that schematically illustrates an ink-jet printer in which the invented method is useful.

DETAILED DESCRIPTION OF THE PREFERRED EMBODIMENT AND BEST MODE OF CARRYING OUT THE INVENTION

Referring first to FIG. 1, a printer system constructed in accordance with the preferred embodiment of the invention is schematically indicated in block diagram form at 10. Printer system 10 may be seen to include a printer 12 including a printer controller 14 operatively coupled with a control console keypad 16 and a non-volatile memory 18, and four color ink-jet pens or cartridges 20, 22, 24, 26 mounted, for example, on a reciprocable carriage 28. Those of skill in the art will appreciate that reciprocal movement of carriage 28 and firing of pens 20, 22, 24, 26 are controlled by controller 14 to place ink droplets on a conventional white print medium (not shown) the advancement orthogonally past carriage 28 of which is conventionally controlled, e.g. by a paper feed motor and opposing rollers (also not shown).

Within the spirit and scope of the invention, printer 12 may be instructed to print four-color images, including text, by an operatively connected host computer or printer server such as computer 30 to which a personal computer (PC) or terminal 32 is connected, or alternatively as indicated by a dashed line may be directly operatively connected to PC 32. All such conventional connections and control and monitoring of printer 12—e.g. to a logical printer server, driver or mechanism capable of commanding the printer to print and monitoring its print status—are contemplated, and are within the spirit and scope of the invention.

Referring still to FIG. 1, it will be understood by those of skill in the art that non-volatile memory 18 may be an integral part of printer controller 14, which may be, for example, a programmed microprocessor, or may be connected thereto over a data and address bus as illustrated in FIG. 1. Those of skill also will appreciate that, not shown in FIG. 1 for the sake of simplicity and brevity, are conventional ink-jet printer elements such as drive motors (e.g. servo motors), that control the advancement of print media past the carriage mounting the four color pens and that control the reciprocation of the pens-mounting carriage. For illustrative purposes herein, pens 20, 22, 24 and 26 will be referred to in the alternative by their primary, or printing process, ink colors cyan (C), yellow (Y), magenta (M) and black (K), respectively. It will be appreciated that other colors, e.g. red, green, blue and black that achieve preferably full visible color spectrum, high-quality printing results are contemplated and are within the spirit and scope of the invention.

Turning now to FIG. 2, a first one 34 of the defined alignment test patterns printed in accordance with the invention is shown, albeit somewhat schematically. It will be appreciated that FIGS. 4A, 4B, 5A and 5B, to be described below, illustrate in more detail how each of the individual graphics shown in FIG. 2 may be produced. First alignment test patterns 34 preferably includes a horizontal array of plural, vertically oriented graphics that are printed by printer controller 14 during a pen alignment mode of operation of ink-jet printer 12 in accordance with a preferred method of the invention. Those of skill in the art will appreciate that one or more such graphics may be printed, within the spirit and scope of the invention, although preferably a regular array of plural ones of such graphics are printed, as shown.

First alignment test pattern 34 will be understood to include a regular array of at least a first alignment graphic, each being produced by ink droplets from a first of the plural color pens, e.g. the black (K) one, and preferably adjacent thereto and nominally aligned therewith at least a second alignment graphic, each being produced by ink droplets from a second, e.g. cyan (C), and a third, e.g. yellow (Y), of the plural color pens.

It will be appreciated that preferably one of the second and third of the plural color pens is of relatively invisible ink, e.g. yellow (Y), and the other of the second and third of the plural color pens is of relatively visible ink, e.g. cyan (C) or magenta (M), whereby the second alignment graphic is produced by ink droplets of different colors that, in combination, are relatively visible. Preferably, the first alignment graphic is generally linear, e.g. a straight line segment, as may be seen, and the second alignment graphic is generally rectangular having in a generally linear interior region thereof only one, e.g. yellow (Y), of the second and third colors. In FIG. 2, the linear interior region is coded by striped shading while the remainder of the graphic is coded by crisscross, or diamond-pattern shading indicating a combination of ink colors.

FIG. 2 illustrates a preferred first alignment pattern 34 that makes it easy for an operator or user of printer 12 to view the pattern and to choose the pattern that is most desirable or represents the best horizontal inter-pen alignment among the various printed alternatives.

For best results, it is believed that having a linear interior region that is of substantially the same dimension as the first alignment graphic is preferable. In other words, as may be seen from FIG. 2, the yellow linear interior region (shown in black in FIG. 2, but labeled with a "Y") is dimensioned preferably identically with the black line segment (labeled "K"), thereby rendering an alignment graphic that enables the operator to visually choose the pattern having better or most preferably the best linear alignment (i.e. collinearity) between the black line segment, or hash-mark, and the yellow linear interior region of the cyan ("C") rectangular region, or patch. Most would agree that, in the illustrated example of FIG. 2, the third-from-left graphic represents the best horizontal alignment between the black and the yellow pens.

Importantly, the yellow linear interior region, or yellow line segment, is rendered visible by the overlaying of a yellow patch with a cyan patch having no linear interior region. It will be appreciated that the overlaying of a relatively invisible ink with a relatively visible ink renders a graphic result that improves the apparent contrast between the invisible ink and a white print medium background. The colors that may be usefully combined to produce the second alignment graphic—whether by the preferred method illustrated in FIGS. 4A and 4B or by the alternative method illustrated in FIGS. 5A and 5B, described below—should produce a visible contrast also between the rectangular patch and the linear interior region, or bounded, or color combination-produced, hash mark. This is because the patch acts as a background for the color bounded hash mark. By reference to FIGS. 5A and 5B, below, alternative methods within the spirit and scope of the invention will be described that involve overlays of second and third color inks.

In addition to the printing step described and illustrated immediately above, the preferred form of the invented interactive color pen alignment method further includes the step of providing a user with a mechanism to indicate to the printer whether the first and second alignment graphics are sufficiently precisely aligned with one another. In accordance with the most preferred method, such is accomplished by printing plural test patterns and providing the user with an input selection mechanism, e.g. printer control console keypad 16 or PC 32, for choosing the best among them. Within the spirit and scope of the invention, however, a single instance of the graphics shown in FIG. 2 might be printed, and the operator might be provided with the simpler option of accepting or rejecting the alignment corresponding with such graphic. If the printer's controller 14 determines from the operator's input the printed graphic is unacceptable, a new graphic might be printed that represents an adjusted alignment between, for example, the black and yellow pens, and the process might be repeated. All such interactive methods are within the spirit and scope of the invention.

It will be appreciated from FIG. 2 that—by the printing of plural ones, e.g. seven, of such defined alignment test patterns, with a progressive relative alignment between the first and second alignment graphics thereof—the operator is given a reasonable choice of vertical alignment options from which to choose. Preferably, the keypad and/or a control console display (not shown in FIG. 1), or some other mechanism is provided to the user to permit the user to indicate to the printer which one of such plural patterns is more or most precisely aligned. Such may, in accordance for example with the teachings of our European Patent No. EP 0589718, involve soft programming of various of the pads on the printer's keypad and interpreting the depression of one or more of such pads as the user's selection of a preferred one of the alignment test patterns.

Turning briefly next to FIG. 3, a second one 36 of the defined alignment test patterns printed in accordance with the invention is shown, similarly to that of FIG. 2. It will be appreciated by those of skill in the art that second alignment test pattern 36 is an array of alternative plural graphic elements that permit interactive vertical alignment of the four separate color pens or cartridges. The graphics arrayed in FIG. 3 are similar to those of FIG. 2 but it may be seen that each is rotated clock-wise 90° so that the progressive, slight misalignment of the first pattern and the second pattern is vertical rather than horizontal as in FIG. 2. It will also be appreciated from FIG. 3 that it is the center one of the plural graphics which visually represents the best alignment of the first color, e.g. black ("K"), and the second color, e.g. yellow ("Y").

Importantly, the invented concept of producing the second pattern nevertheless involves, in relation to the vertical alignment method suggested by FIG. 3 as in the horizontal alignment method suggested by FIG. 2, the combination of a relatively invisible color such as yellow and another color, which may or may not be relatively visible, such as cyan ("C") to produce a third color over most of the second pattern, minus a preferably linear feature, or subregion, therein of the relatively invisible color. The color combination preferably is chosen, e.g. green that results from the combination of yellow and cyan, such that, in all but the linear subregion therein, the color combination contrasts more favorably with a white print medium, which appears in the background, than would the relatively invisible color alone. It will be appreciated that any two colors that, when combined, produce to the naked eye a more visible graphic than either alone are within the purview of the invention.

Turning now to FIGS. 4A and 4B, it may be seen how rectangular graphic elements of FIG. 2 (and thus of FIG. 3, by simple rotation) may be produced. It will be appreciated that a variety of techniques may be used, within the spirit and scope of the invention. FIGS. 4A and 4B illustrate the use of a rectangular patch of cyan (indicated in FIG. 4A by left-to-right, downwardly sloping lining) and a linear hash-mark of yellow (indicated in FIG. 4A by left-to-right, upwardly sloping lining) which combine by overlaying ink droplets into a rectangular cyan patch having a green hash-mark in a nominally defined location, e.g. centrally located, therein. It may be seen from FIG. 4B that the juxtaposition of the relatively high contrast green line segment (indicated by crosshatching) within a cyan background and the black line segment ("K") of preferably approximately equal dimension is readily perceived against a white print medium as external background. Yet the accuracy of the alignment of the resulting green line segment, which represents the color combination of cyan and yellow, is indicative of the alignment accuracy of the yellow (Y) and the black (K) ink-jet pens. As stated above, it is within the scope of the invention to use the combination of any two colors to improve the contrast of the resulting overlaid graphic result of the color combination, and thus its visibility to the naked eye.

It may be understood that the width of the rectangular patch shown in FIGS. 4A, 4B, 5A and 5B preferably represents the worst case misalignment that is anticipated between any two color pens. If the color pen that produces the rectangular patch is mis-aligned relative to the black pen, then the hash mark therein will be off center within the patch but will still be relatively more visible because of the color combination. Thus, ihe pen that produces the hash mark may be aligned with the black pen before or after alignment of the pen that produces the rectangular patch. Those of skill will appreciate that these principles also apply to the alternative method of producing the second alignment graphic, as will now be described.

Turning finally to FIGS. 5A and 5B, it may be seen how the graphic elements alternatively may be produced. FIGS. 5A and 5B illustrate the use of a rectangular patch of cyan (again, indicated by left-to-right, downwardly sloping lining) and a generally rectangular patch of yellow (indicated by left-to-right, upwardly sloping striped lining) having a defined linear interior region defining a blank straight line segment which combine by overlaying ink droplets into a rectangular green patch (indicated by crosshatching) having a defined linear interior cyan region (indicated by left-to-right downwardly sloping lining) at a nominally defined location, e.g. centrally located, therein, the interior region preferably defining a straight line segment that nominally is aligned with an adjacently printed black line segment.

It will be appreciated that, within the spirit and scope of the invention, the invisible ink graphic may instead be overlain with the visible ink graphic, i.e. the invisible ink graphic may be printed as background and the visible ink graphic as foreground. It is believed also that there is no necessarily important tuning between the printing of the two graphic components of the second alignment graphic, nor that ink bleeding between the inks from the second and third of the plural pens is either necessary or desirable. This is because the invented method relies on a visual perception on the part of the operator of the color combination, which the human eye spatially integrates into a perceived color that is different from the graphic component colors and of higher visual contrast with a white background than would be that of the relatively invisible color alone.

Thus, it is believed to be unimportant whether the ink droplets from the second and third of the plural color pens touch one another or mix—although of course they may, within the spirit and scope of the invention—or whether instead they are in distinct pixel locations of the printed graphic. In other words, the printing of the alignment test pattern including the second alignment graphic may be performed by producing droplets first of the relatively visible ink and thereafter of the relatively invisible ink. Alternatively, the printing of the alignment test pattern including the second alignment graphic may be performed by producing droplets first of the relatively invisible ink, e.g. yellow (Y), and thereafter of the relatively visible ink, e.g. cyan (C). Finally, the printing of the alignment test pattern including the second alignment graphic may be performed by producing droplets first of one relatively invisible ink and thereafter another relatively invisible ink to produce a color combination that is relatively visible, i.e. more visible than at least one of the two different colors alone.

Those of skill in the art will appreciate that any complementary first and second alignment graphics may be used, within the spirit and scope of the invention, to produce visual targets for the operator of printer 12. For example, a conventional circular cross-hair (⊕), a virgule (/ or \), a diagonal cross (X), a bull's eye, etc. may serve as well. Thus, it is contemplated that target features having other than rectangular patches and other than linear hash-marks suitably may be produced for interactive, semi-automatic, inter-pen alignment in accordance with the invention. By the preferred method of the invention, the width of the rectangular patch approximates the worst-case alignment that might be expected between any two pens, and the width of the linear graphic or hash mark represents a tradeoff between the need for high resolution (which would favor its thinness) and visibility (which would favor its thickness).

It also will be appreciated that the first alignment test graphic need not be black, within the spirit and scope of the invention, but instead may be one of the primary or printer process colors. In other words, the invented method may involve alignment targets as between two or more primary colors neither of which is black. While typically it is appreciated that if the primary colors are each adequately aligned with black, then they typically are adequately aligned with one another, there may be more demanding applications where the invented alignment method is applicable. Thus, within the spirit and scope of the invention is the described alignment method wherein the first alignment graphic is chosen from among the print process, or primary, colors and wherein the second alignment graphic is chosen from among the remaining print process, or primary, colors.

Those of skill in the art will appreciate that the invented method lends itself to ink-jet printing in a variety of applications, including production printing. It will also be appreciated that the choice of preferred alignment test pattern by the user may be conveyed to the printer's controller in any suitable way, within the spirit and scope of the invention. For example, the user may make the choice at a computer terminal that is in communication with the printer server, or otherwise able to communicate the choice to the printer's controller. Alternatively, the user may communicate his or her choice to the printer's controller via a protocol that utilizes, for example, a keypad on the printer's console, e.g. by treating the printer control console keys as soft keys that have special meaning when the printer is in its interactive pen-alignment mode of operation as illustrated and described herein. Any and all suitable methods of providing the user with the ability to influence the selection of the preferred inter-pen alignment is within the spirit and scope of the invention.

Accordingly, while the present invention has been shown and described with reference to the foregoing preferred method, it will be apparent to those skilled in the art that other changes in form and detail may be made therein without departing from the spirit and scope of the invention as defined in the appended claims.

I claim:

1. A user-interactive color pen alignment method for use in connection with a printer having plural color pens, the method comprising the steps of:

printing a predefined alignment test pattern on a print medium the pattern including a first alignment graphic produced by ink droplets from a first of the plural color pens and a second alignment graphic produced by ink droplets from a second and third of the plural color pens with such first and second alignment graphics being nominally aligned with one another, whereby the second alignment graphic is purposefully produced by ink droplets of different colors that, in combination, are relatively more visible to the naked eye than at least one of the colors alone, and providing a user with a mechanism to indicate to the printer whether the first and second alignment graphics are sufficiently precisely aligned with one another.

2. The method of claim 1, wherein plural alignment test patterns are printed with a progressively changing relative alignment between first and second alignment graphics of successive alignment test patterns, and wherein the user is able to indicate to the printer which one of such plural alignment test patterns is more precisely aligned.

3. The method of claim 1, wherein the color of ink droplets from one of the second and third color pens is yellow.

4. The method of claim 3, wherein the color of ink droplets from another of the second and third color pens is chosen from colors including cyan and magenta.

5. The method of claim 4, wherein the first alignment graphic is black.

6. The method of claim 1, wherein the first alignment graphic is of a color chosen from among print process colors and wherein the second alignment graphic is of colors chosen from among remaining print process colors.

7. The method of claim 1, wherein the first alignment graphic is a straight line segment.

8. The method of claim 7, wherein the second alignment graphic is a generally rectangular region having, in a linear interior region thereof, only one of the colors produced by the second and third color pens.

9. The method of claim 8, wherein the linear interior region is of substantially the same dimension as the first alignment graphic.

10. The method of claim 1, wherein the printing of the alignment test pattern including the second alignment graphic is performed by producing droplets first of a relatively visible ink and thereafter of a relatively invisible ink.

11. The method of claim 1, wherein the printing of the alignment test pattern including the second alignment graphic is performed by producing droplets first of a relatively invisible ink and thereafter of a relatively visible ink.

* * * * *